US011759009B1

(12) United States Patent
Lo

(10) Patent No.: US 11,759,009 B1
(45) Date of Patent: Sep. 19, 2023

(54) STORAGE BOX COMBINATION THAT IS STACKED UP AND DOWN AND IS ASSEMBLED LEFT AND RIGHT

(71) Applicant: Ten Square Inc., Bethpage, NY (US)

(72) Inventor: Feng-Jung Lo, Bethpage, NY (US)

(73) Assignee: Ten Square Inc., Bethpage, NY (US)

( * ) Notice: Subject to any disclaimer, the term of this patent is extended or adjusted under 35 U.S.C. 154(b) by 0 days.

(21) Appl. No.: 17/960,266

(22) Filed: Oct. 5, 2022

(51) Int. Cl.
*A47B 47/04* (2006.01)
*A47B 47/00* (2006.01)

(52) U.S. Cl.
CPC ..... *A47B 47/047* (2013.01); *A47B 47/0091* (2013.01); *A47B 2220/0058* (2013.01)

(58) Field of Classification Search
CPC ..... A47B 47/047; A47B 2220/0058; A47B 47/0091; A47B 87/0276; A47B 45/00; A47B 87/008; A47B 87/00; A47B 87/005; A47B 87/02; A47B 87/0207; A47B 87/0215; A47B 87/0223; A47B 87/0246; A47B 87/0253; A47B 87/0269; A47B 87/0284; A47B 87/0292; A47B 47/0066; A47B 47/0075
See application file for complete search history.

(56) References Cited

U.S. PATENT DOCUMENTS 3,583,780 A * 6/1971 Berkowitz ..... A47B 47/042 312/108
3,696,960 A * 10/1972 Smirle ..... B65D 25/02 220/DIG. 25
6,209,976 B1 * 4/2001 Shear ..... A47B 47/02 312/263
7,967,401 B2 * 6/2011 Hsu ..... A47B 47/0033 312/111
8,113,600 B2 * 2/2012 Zalewski ..... A47B 47/0041 312/107
8,955,928 B2 * 2/2015 Cheng ..... A47F 5/0018 312/265.2
9,445,666 B2 * 9/2016 Chang ..... A47B 55/02
10,555,605 B1 * 2/2020 Berger ..... A47B 47/047
10,856,658 B2 * 12/2020 Berloni ..... A47B 77/02
11,425,996 B2 * 8/2022 DeShon ..... A47B 87/008
2004/0251043 A1 * 12/2004 Chung ..... H02G 3/086 174/50
2006/0207957 A1 * 9/2006 Chen ..... A47B 47/0066 211/183
2006/0250052 A1 * 11/2006 Davis ..... F16B 12/26 312/107
2010/0019630 A1 * 1/2010 Leng ..... F16B 12/50 312/107
2010/0084356 A1 * 4/2010 Wang ..... A47B 87/005 211/186
(Continued)

*Primary Examiner* — Devin K Barnett

(57) ABSTRACT

A storage box combination includes multiple storage boxes. Each of the storage boxes includes two side boards, at least two laminates, and at least one back board. The two side boards are arranged in parallel. The at least two laminates are located between the two side boards. The at least one back board is located between the two side boards. The storage boxes are arranged from left to right or stacked from bottom to top, in which any two adjacent storage boxes are connected by screws. Thus, the storage boxes are locked by screws, so that the number and arrangement of the storage boxes can be adjusted freely.

4 Claims, 9 Drawing Sheets

(56) References Cited

U.S. PATENT DOCUMENTS

| | | | | |
|---|---|---|---|---|
| 2012/0242200 | A1* | 9/2012 | Keragala | A47B 47/042<br>312/107 |
| 2013/0048632 | A1* | 2/2013 | Chen | B65D 9/24<br>220/4.33 |
| 2016/0081472 | A1* | 3/2016 | Aleisa | A47B 47/0091<br>211/188 |
| 2021/0386197 | A1* | 12/2021 | Merten | A47B 47/047 |

* cited by examiner

STORAGE BOX COMBINATION THAT IS STACKED UP AND DOWN AND IS ASSEMBLED LEFT AND RIGHT

BACKGROUND OF THE INVENTION

1. Field of the Invention

The present invention relates to a furniture product and, more particularly, to a storage box combination or storage rack.

2. Description of the Related Art

A storage box is used for placing and receiving articles. However, the conventional storage box has a fixed volume that cannot be adjusted according to the user's practical requirement so that the space for receiving the articles is not large enough. In addition, the conventional storage box may occupy a too large volume when the indoor space is limited.

BRIEF SUMMARY OF THE INVENTION

The primary objective of the present invention is to provide a storage box combination that is stacked up and down and is assembled left and right.

In accordance with the present invention, there is provided a storage box combination comprising multiple storage boxes. Each of the storage boxes includes two side boards, at least two laminates, and at least one back board. The two side boards are arranged in parallel. Each of the two side boards is upright. Each of the two side boards has a face provided with at least two first slots and a second slot. The at least two first slots are arranged from bottom to top and are parallel with each other. The second slot is perpendicular to the at least two first slots. The at least two first slots of the two side boards align with each other. The second slots of the two side boards align with each other. The at least two laminates are located between the two side boards. Each of the at least two laminates has two sides each provided with an insert extending outward. The insert of each of the at least two laminates is inserted into one of the at least two first slots of one of the two side boards, so that the at least two laminates are parallel with each other. The insert of each of the at least two laminates is locked onto one of the two side boards by screws. The at least one back board is located between the two side boards. The at least one back board to has two sides each inserted into the second slot of one of the two side boards, so that the at least one back board is upright between the at least two laminates. The storage boxes are arranged from left to right or stacked from bottom to top, in which one of the two side boards of one of the storage boxes is closely juxtaposed to and locked with one of the two side boards of another one of the storage boxes by screws, and one of the at least two laminates of one of the storage boxes is closely juxtaposed to and locked with one of the at least two laminates of another one of the storage boxes by screws.

According to the primary advantage of the present invention, the storage box combination is assembled to have different sizes so as to adjust the storage space and the volume thereof.

According to another advantage of the present invention, the storage boxes are locked by screws, so that the number and arrangement of the storage boxes can be adjusted freely to change the height, width, and storage space of the storage box combination to satisfy the user's requirement.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
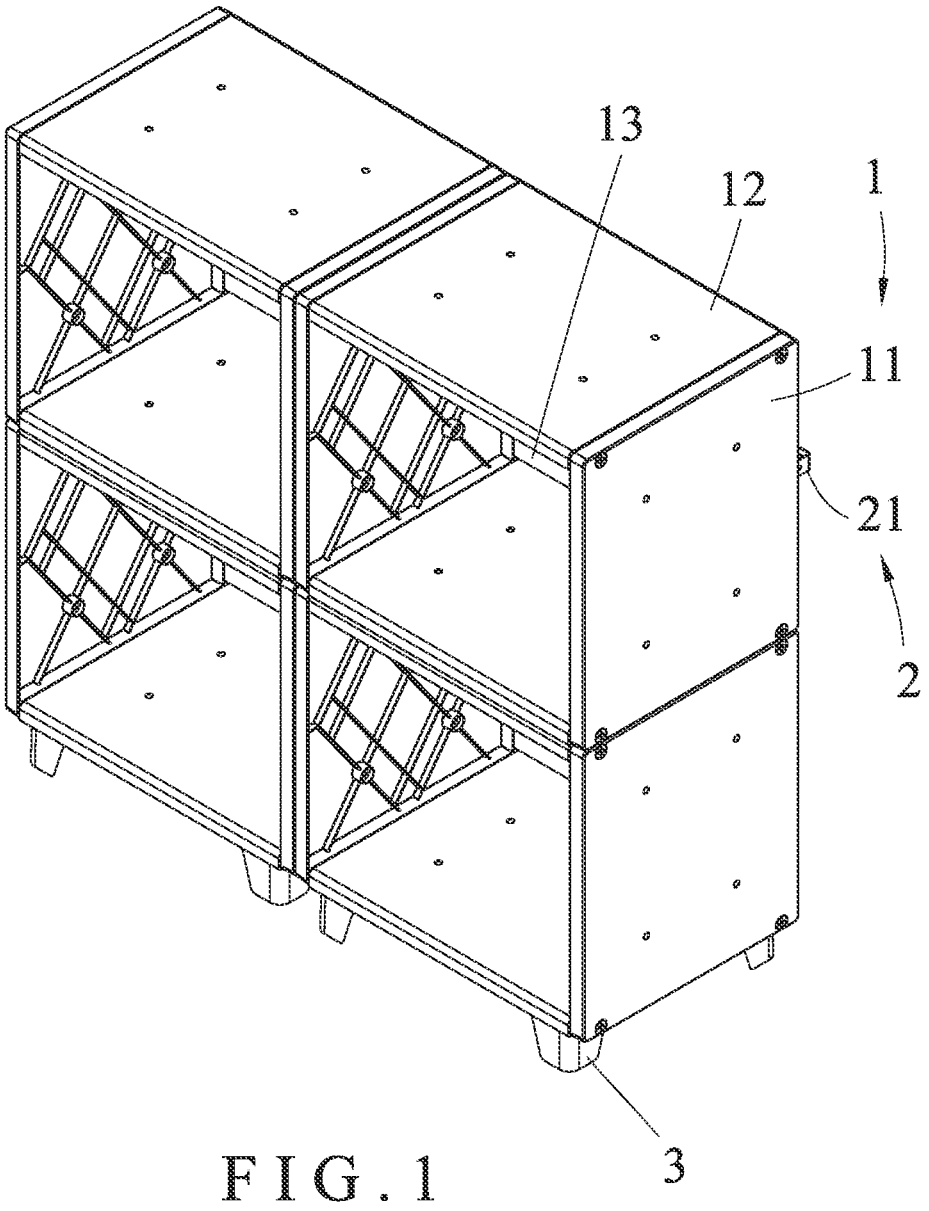
FIG. 1 is a perspective view of a storage box combination in accordance with the preferred embodiment of the present invention.
Figure 2:
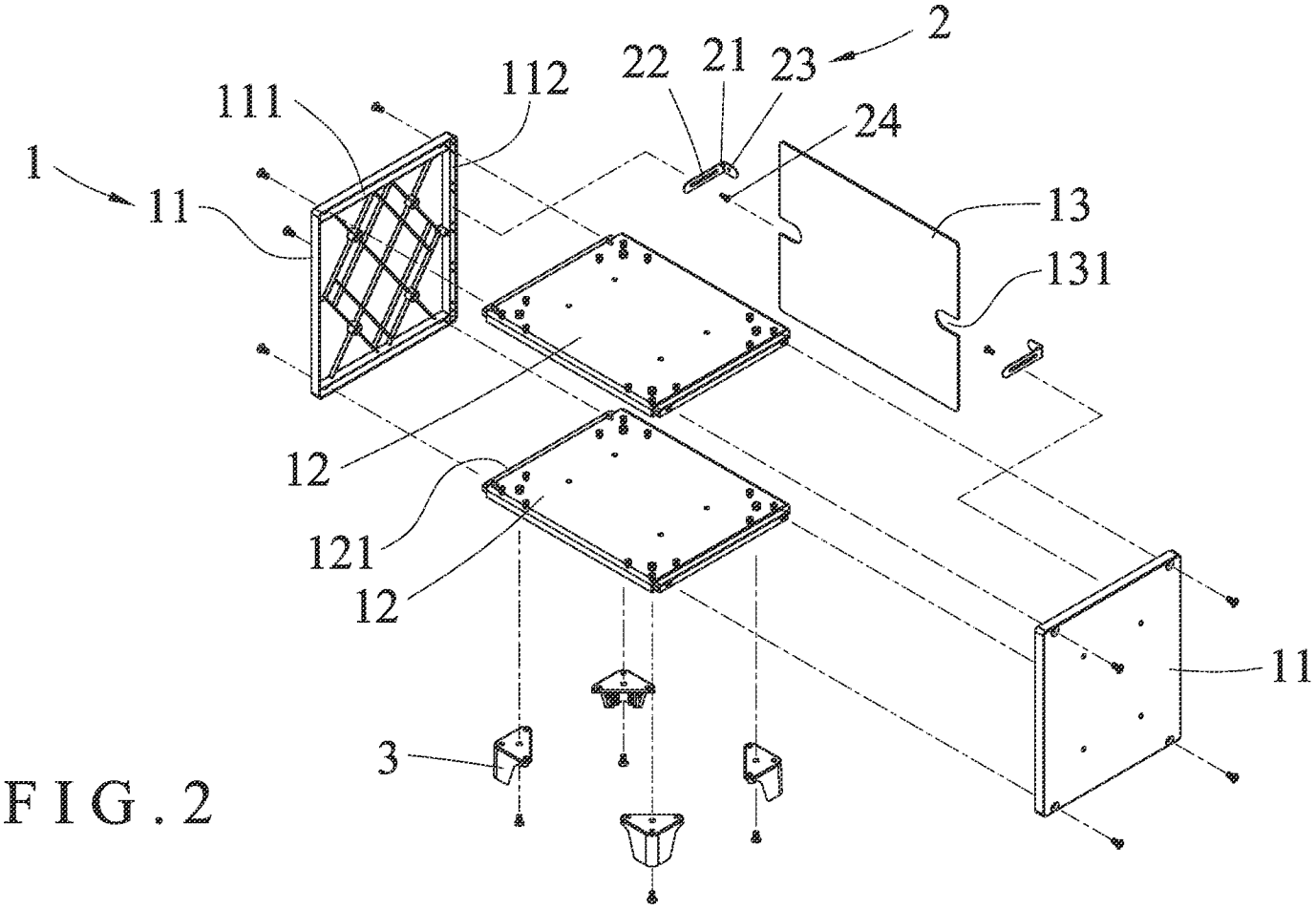
FIG. 2 is an exploded perspective view of the storage box combination in accordance with the preferred embodiment of the present invention.
Figure 3:
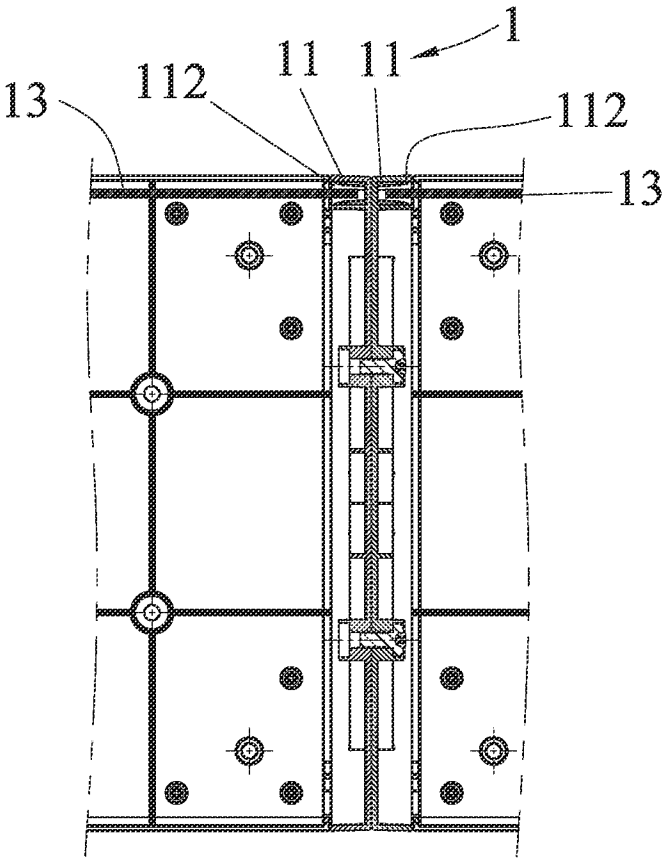
FIG. 3 is a cross-sectional view showing two storage boxes of the storage box combination are juxtaposed and connected by screws.
Figure 4:
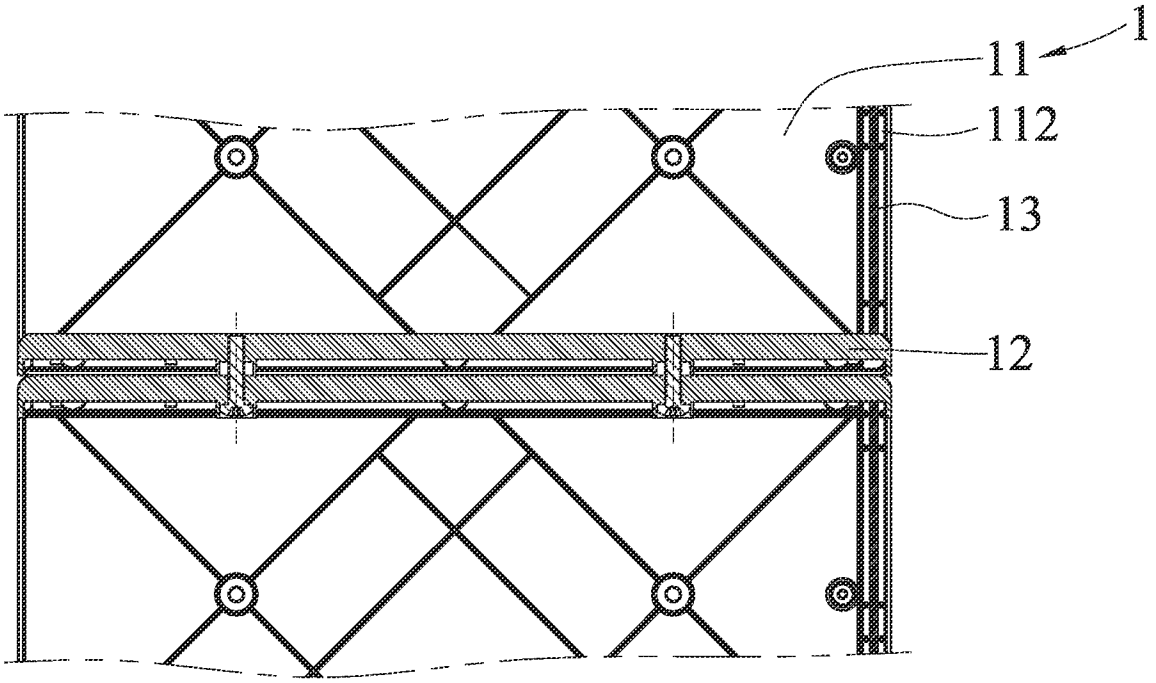
FIG. 4 is a cross-sectional view showing two storage boxes of the storage box combination are stacked and connected by screws.
Figure 5:
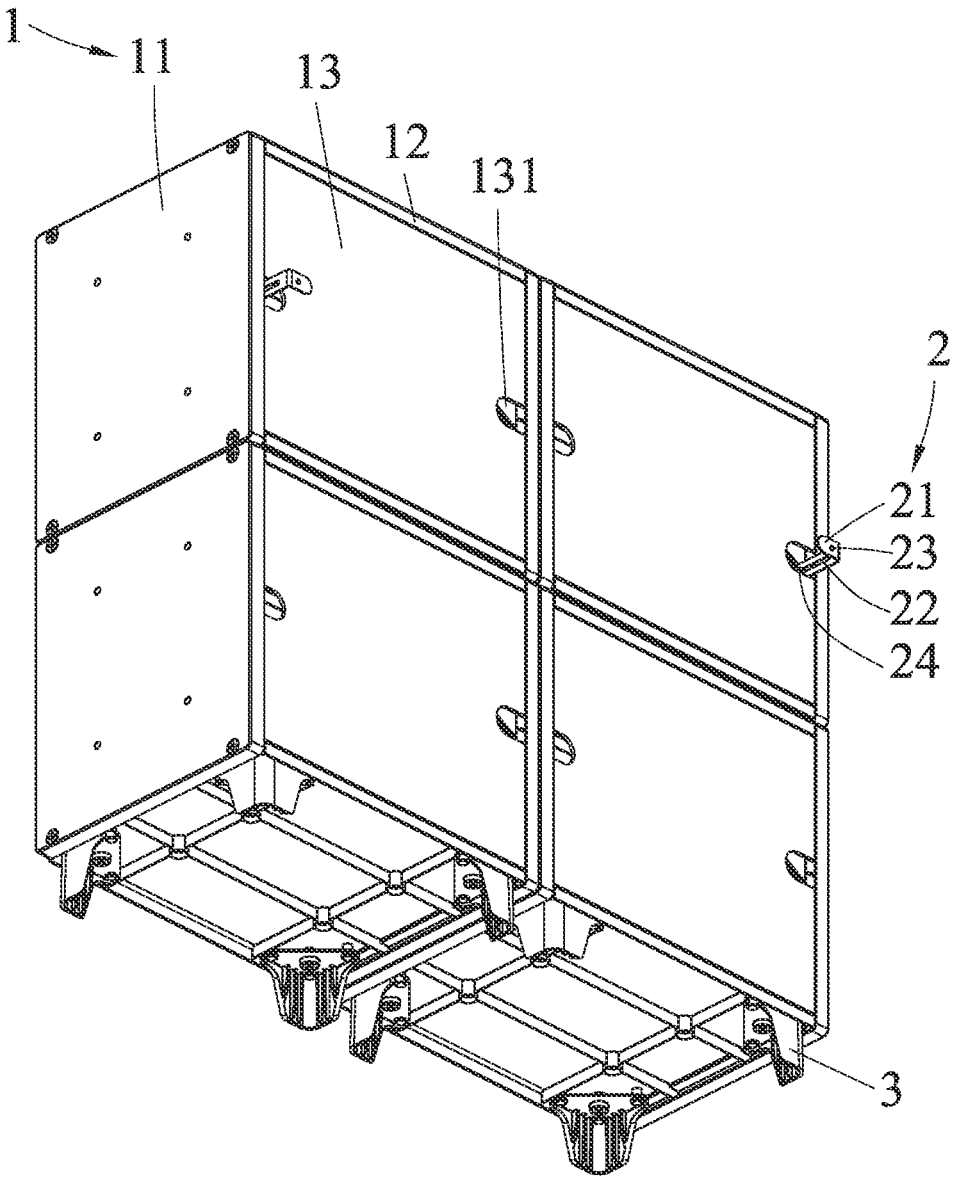
FIG. 5 is another perspective view of the storage box combination in accordance with the preferred embodiment of the present invention.

Referring to the drawings and initially to FIGS. 1-5, a storage box combination in accordance with the preferred embodiment of the present invention comprises multiple storage boxes 1.

Each of the storage boxes 1 includes two side boards 11, at least two to laminates (or plywoods or support boards) 12, and at least one back board 13.

The two side boards 11 are arranged in parallel. Each of the two side boards 11 is upright. Each of the two side boards 11 has a face provided with at least two first slots 111 and a second slot 112. The at least two first slots 111 are arranged from bottom to top and are parallel with each other. The second slot 112 is perpendicular to the at least two first slots 111. The at least two first slots 111 of the two side boards 11 align with each other. The second slots 112 of the two side boards 11 align with each other.

The at least two laminates 12 are located between the two side boards 11. Each of the at least two laminates 12 has two sides each provided with an insert 121 extending outward. The insert 121 of each of the at least two laminates 12 is inserted into one of the at least two first slots 111 of one of the two side boards 11, so that the at least two laminates 12 are parallel with each other and are perpendicular to the two side boards 11. The insert 121 of each of the at least two laminates 12 is locked onto one of the two side boards 11 by screws.

The at least one back board 13 is located between the two side boards 11. The at least one back board 13 has two sides each inserted into the second slot 112 of one of the two side boards 11, so that the at least one back board 13 is upright between the at least two laminates 12.

In assembly, the storage boxes 1 are arranged from left to right (or side by side) or stacked from bottom to top as shown in FIG. 1, in which one of the two side boards 11 of one of the storage boxes 1 is closely juxtaposed to and locked with one of the two side boards 11 of another one of the storage boxes 1 by screws, and one of the at least two laminates 12 of one of the storage boxes 1 is closely juxtaposed to and locked with one of the at least two laminates 12 of another one of the storage boxes 1 by screws.

In the preferred embodiment of the present invention, four storage boxes 1 construct a 2×2 matrix as shown in FIG. 1.

In the preferred embodiment of the present invention, the at least one back board 13 is provided with at least one opening 131. Preferably, the at least one back board 13 is provided with two openings 131. The storage box combination further comprises at least one anti-fall device 2. Preferably, the storage box combination comprises multiple anti-fall devices 2. The at least one anti-fall device 2 includes an anti-fall bar 21 and a limit member 24. The anti-fall bar 21 passes through the at least one opening 131 of the at least one back board 13. The anti-fall bar 21 has an L-shaped profile in cross section. The anti-fall bar 21 has a first portion provided with a slideway 22 and a second portion provided with a fixing hole 23. The limit member 24 extends through the slideway 22 of the anti-fall bar 21 and is secured to one of the two side boards 11.

In the preferred embodiment of the present invention, the storage box combination further comprises multiple stands 3 mounted on one of the at least two laminates 12 at the lowermost position of the storage boxes 1. Preferably the stands 3 are locked onto one of the at least two laminates 12 by screws.

In practice, again referring to FIGS. 1-5, articles are placed on one of the at least two laminates 12 of each of the storage boxes 1. At this time, the storage boxes 1 are connected by screws. Thus, the number of the storage boxes 1 is adjusted according to the user's requirement. For example, the storage boxes 1 are adjusted to construct a 2×2 matrix as shown in FIG. 1. Alternatively, the storage boxes 1 are adjusted to construct a 3×3 matrix when the user needs a larger space to place the articles.

It is appreciated that, a screw extends through the fixing hole 23 of the anti-fall bar 21 of the at least one anti-fall device 2 and is screwed into a wall to affix the at least one anti-fall device 2 to the wall so that the storage boxes 1 are fixed. Thus, the limit member 24 stops an inside of the slideway 22 to prevent the storage box combination from falling down when an earthquake occurs. In addition, the storage boxes 1 are suspended and supported by the at least one anti-fall device 2 to function as a cabinet or cupboard.

As shown in FIGS. 1-5, each of the storage boxes 1 includes two laminates 12 and a back board 13. Each of the two side boards 11 is provided with two first slots 111.

Figure 6:
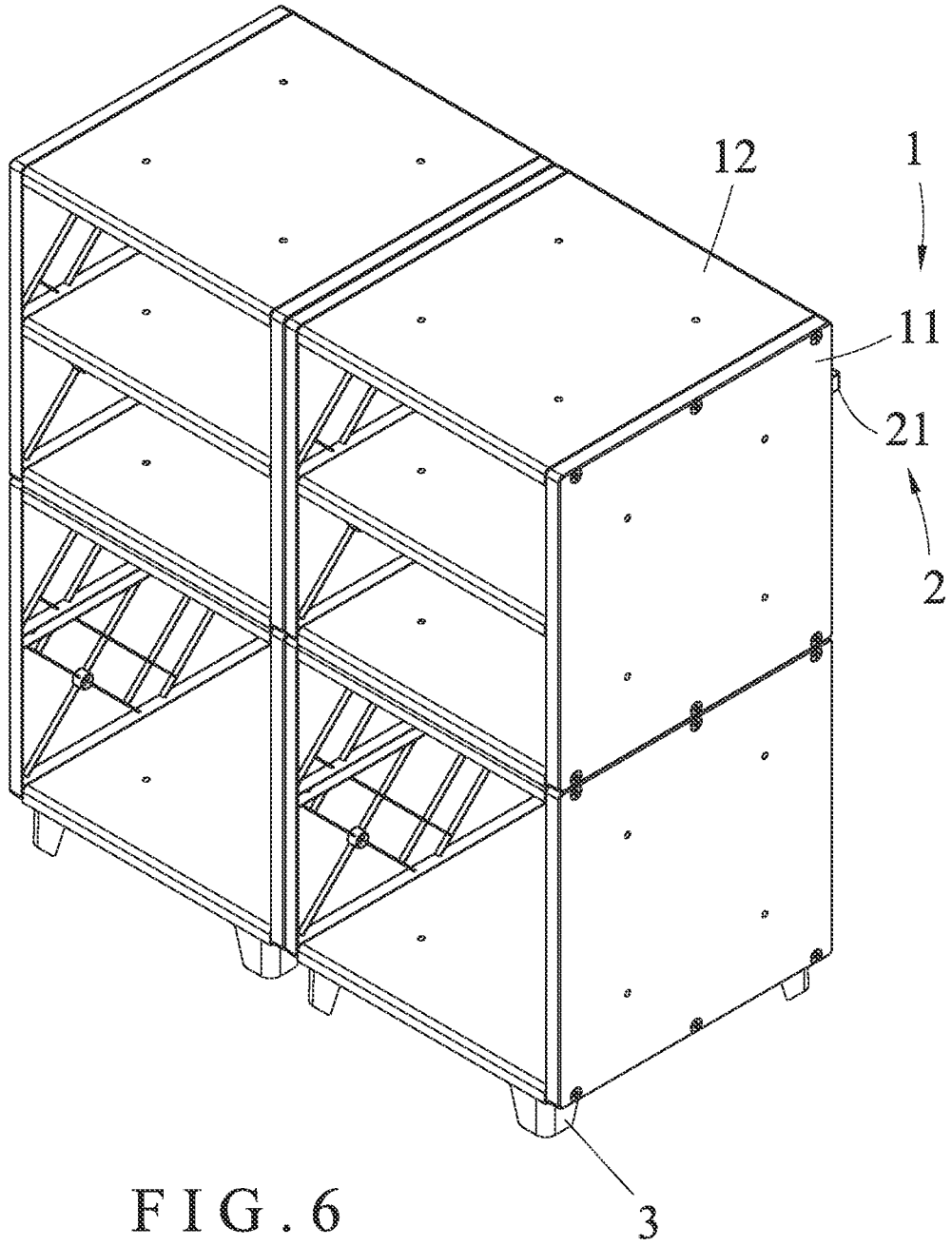
FIG. 6 is a perspective view of a storage box combination in accordance with the second preferred embodiment of the present invention.
Figure 7:
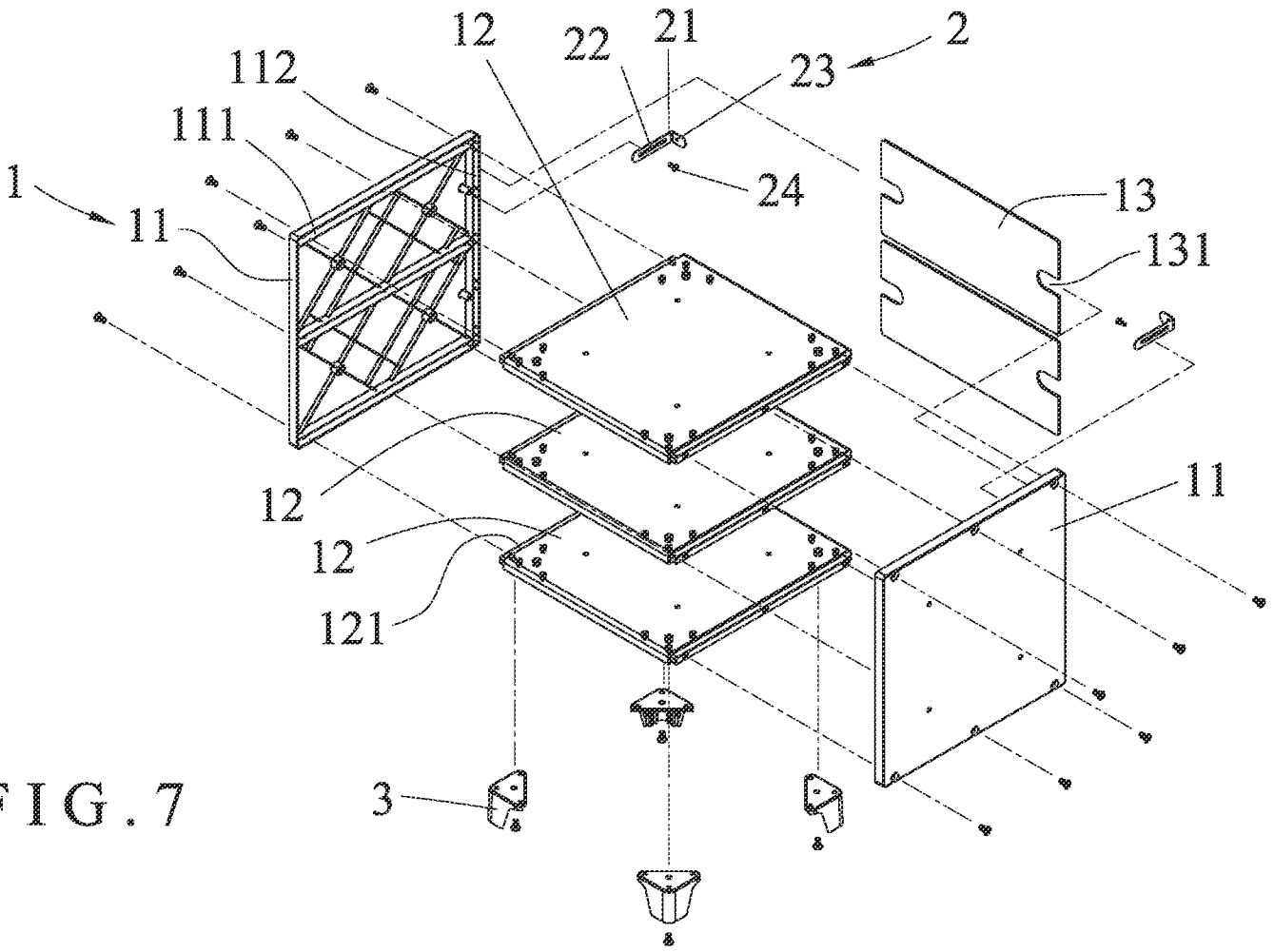
FIG. 7 is an exploded perspective view of the storage box combination in accordance with the second preferred embodiment of the present invention.
Figure 8:
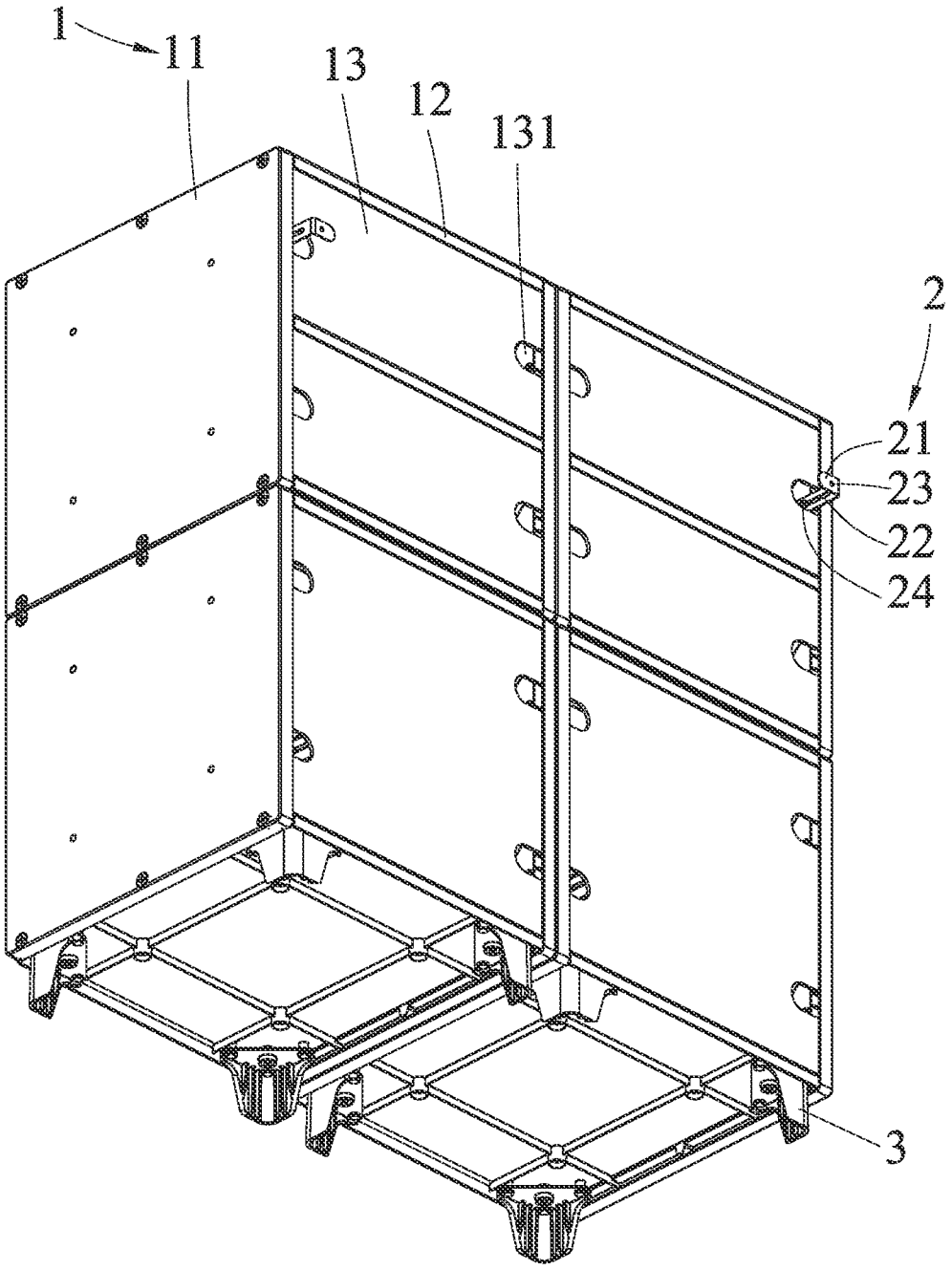
FIG. 8 is another perspective view of the storage box combination in accordance with the second preferred embodiment of the present invention.

As shown in FIGS. 6-8, each of the storage boxes 1 includes three laminates 12 and two back boards 13. Each of the two side boards 11 is provided with three first slots 111. Thus, the back boards 13 have different height so that the partitions of each of the storage boxes 1 can be adjusted according to the user's requirement.

As shown in FIGS. 1 and 6, each of the two side boards 11 is provided with multiple screw holes for locking the screws. Thus, the storage boxes 1 construct a stack bond so that any two of the storage boxes 1 that are stacked from bottom to top align with each other.

Figure 9:
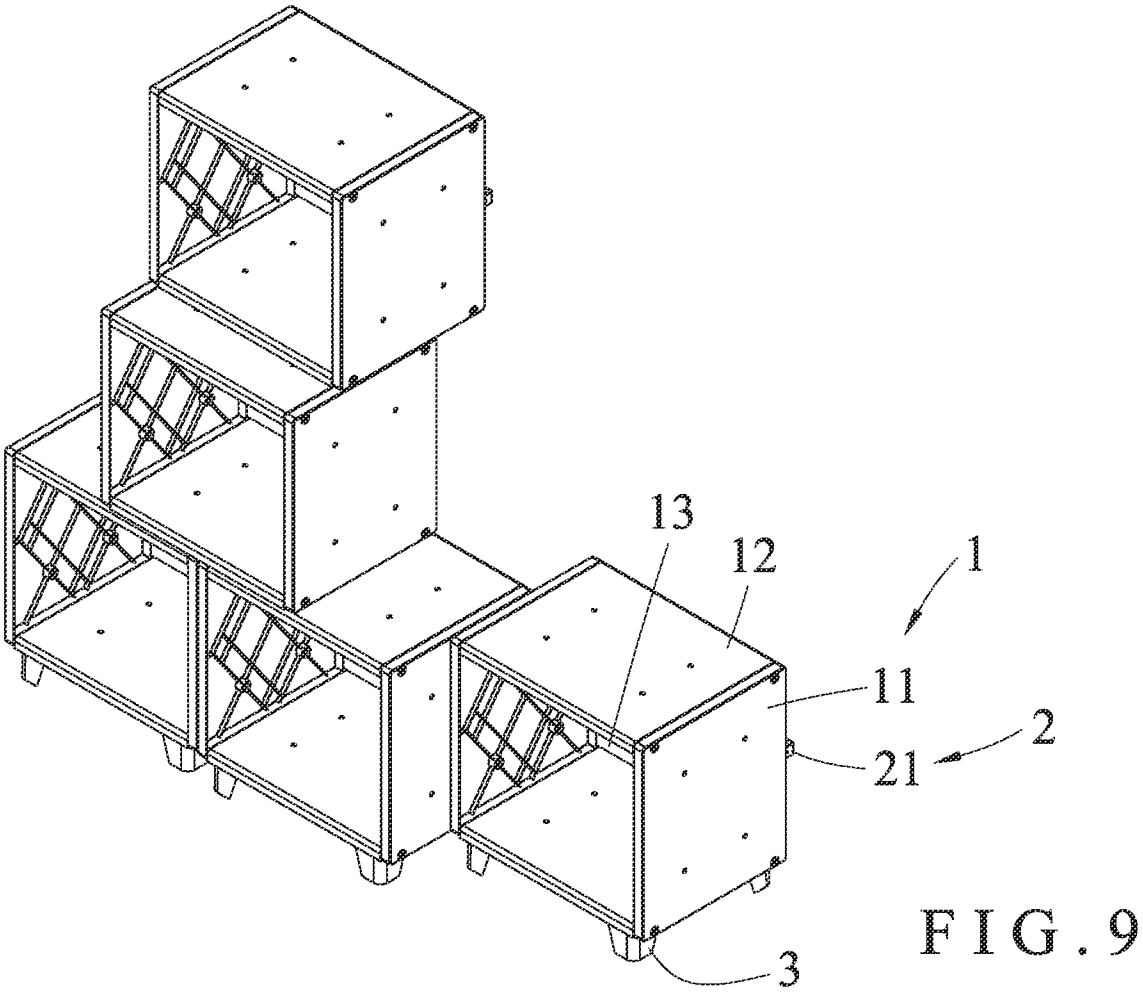
FIG. 9 is a perspective view of a storage box combination in accordance with the third preferred embodiment of the present invention.

As shown in FIG. 9, the storage boxes 1 are arranged in a staggering or alternating manner to construct a stretcher bond so that the center of one of the storage boxes 1 at an upper layer aligns with an intersection of two of the storage boxes 1 at a lower layer. Thus, the storage boxes 1 have various kinds of arrangement.

Alternatively, two stacked storage boxes 1 are misaligned, with an upper one of the two stacked storage boxes 1 resting on projection or a step so that the storage box combination is supported by the projection or step. Alternatively, two juxtaposed storage boxes 1 are misaligned, with the two juxtaposed storage boxes 1 resting on a column (or post) and a wall respectively so that the storage box combination is supported by the column and the wall.

Accordingly, the storage box combination is assembled to have different sizes so as to adjust the storage space and the volume thereof. In addition, the storage boxes 1 are locked by screws, so that the number and arrangement of the storage boxes 1 can be adjusted freely to change the height, width, and storage space of the storage box combination to satisfy the user's requirement.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A storage box combination comprising:

multiple storage boxes;

wherein:

each of the storage boxes includes two side boards, at least two laminates, and at least one back board;

the two side boards are arranged in parallel;

each of the two side boards is upright;

each of the two side boards has a face provided with at least two first slots and a second slot;

the at least two first slots are arranged from bottom to top and are parallel with each other;

the second slot is perpendicular to the at least two first slots;

the at least two first slots of the two side boards align with each other;

the second slots of the two side boards align with each other;

the at least two laminates are located between the two side boards;

each of the at least two laminates has two sides each provided with an insert extending outward;

the insert of each of the at least two laminates is inserted into one of the at least two first slots of one of the two side boards, so that the at least two laminates are parallel with each other;

the insert of each of the at least two laminates is locked onto one of the two side boards by screws;

the at least one back board is located between the two side boards;

the at least one back board has two sides each inserted into the second slot of one of the two side boards, so that the at least one back board is upright between the at least two laminates; and the storage boxes are arranged from left to right or stacked from bottom to top, in which one of the two side boards of one of the storage boxes is closely juxtaposed to and locked with one of the two side boards of another one of the storage boxes by screws, and one of the at least two laminates of one of the storage boxes is closely juxtaposed to and locked with one of the at least two laminates of another one of the storage boxes by screws.

2. The storage box combination as claimed in claim 1, wherein:

the at least one back board is provided with at least one opening;

the storage box combination further comprises at least one anti-fall device;

the at least one anti-fall device includes an anti-fall bar and a limit member;

the anti-fall bar is configured to pass through the at least one opening of the at least one back board;

the anti-fall bar has an L-shaped profile in cross section;

the anti-fall bar has a first portion provided with a slideway and a second portion provided with a fixing hole; and the limit member extends through the slideway of the anti-fall bar and is secured to one of the two side boards.

3. The storage box combination as claimed in claim 1, further comprising:

multiple stands mounted on one of the at least two laminates at a lowermost position of the storage boxes.

4. The storage box combination as claimed in claim 1, wherein at least two adjacent stacked storage boxes from the multiple storage boxes are misaligned or two adjacent juxtaposed storage boxes from the multiple storage boxes are misaligned.

* * * * *